US008205817B2

(12) United States Patent
Brook-Levinson et al.

(10) Patent No.: US 8,205,817 B2
(45) Date of Patent: Jun. 26, 2012

(54) BEAD MILL WITH SEPARATOR

(75) Inventors: Edward Brook-Levinson, Petah Tikva (IL); Boris Petrov, Rehovot (IL); Thierry Jomini, Belfaux (CH)

(73) Assignee: Frewitt Fabrique de Machines SA, Grangegs-Paccot (CH)

( * ) Notice: Subject to any disclaimer, the term of this patent is extended or adjusted under 35 U.S.C. 154(b) by 0 days.

(21) Appl. No.: 12/986,295

(22) Filed: Jan. 7, 2011

(65) Prior Publication Data

US 2011/0168814 A1 Jul. 14, 2011

Related U.S. Application Data

(63) Continuation of application No. PCT/EP2009/058705, filed on Jul. 8, 2009.

(30) Foreign Application Priority Data

Jul. 10, 2008 (EP) ..... 08160153

(51) Int. Cl.
*B02C 17/16* (2006.01)

(52) U.S. Cl. ..... 241/171; 241/170

(58) Field of Classification Search ..... 241/171, 241/172

See application file for complete search history.

(56) References Cited

U.S. PATENT DOCUMENTS

| | | | | |
|---|---|---|---|---|
| 4,620,673 | A | 11/1986 | Canepa et al. | |
| 5,797,550 | A | 8/1998 | Woodall et al. | |
| 5,950,943 | A * | 9/1999 | Stehr | 241/171 |
| 5,984,213 | A * | 11/1999 | Woodall et al. | 241/21 |
| 7,243,866 | B2 * | 7/2007 | Stehr et al. | 241/65 |
| 7,264,191 | B2 | 9/2007 | Gerl | |
| 8,002,213 | B2 * | 8/2011 | Stehr | 241/171 |
| 2004/0251337 | A1 | 12/2004 | Araki | |
| 2005/0040266 | A1 | 2/2005 | Gerl | |

FOREIGN PATENT DOCUMENTS

DE 10338592 A1 3/2005

OTHER PUBLICATIONS

International Search Report for PCT/EP2009/058705 dated Nov. 27, 2009.

* cited by examiner

*Primary Examiner* — Faye Francis

(74) *Attorney, Agent, or Firm* — Pearne & Gordon LLP

(57) ABSTRACT

A bead mill for performing wet comminuting including a stationary vessel having an internal wall and forming a milling chamber to be filled at least partly with milling bodies, raw particles and a carrying liquid to form a suspension within the milling chamber; an activator shaft, rotatable around an axis concentric with the stationary vessel and a rotating activator connected to the activator shaft, to comminute said raw particles to produce milled particles; characterized in that said bead mill further comprises a separator, containing a separator chamber disposed substantially vertically, a laminarization portion providing an upward laminar suspension flow within the separator chamber, to separate the milled particles from the milling beads and raw particles depending on the flow velocity of said upward laminar suspension flow.

21 Claims, 6 Drawing Sheets

BEAD MILL WITH SEPARATOR

REFERENCE DATA

The present application is a continuation of international application PCT/EP2009/058705 filed on Jul. 8, 2009, the content of which is incorporated by reference, and which claims priority of European patent application 08160153.6 filed Jul. 10, 2008, the content of which is incorporated by reference.

FIELD OF THE INVENTION

The present disclosure relates to a bead mill, filled with a suspension containing milling bodies, particles to be milled, and a carrying liquid, and comprising a rotating activator. The bead mill allows for milling the particles to a particle a size in the submicrometer range. The present invention also concerns a separator for separating the milled particles below a critical size from the rest of the suspension.

DESCRIPTION OF RELATED ART

Bead mills usually comprise a grinding chamber to be filled at least partly with grinding media and material to be ground and has an inlet for material to be ground and an outlet for crushed material, an agitator having an inner shaft end inside the grinding chamber, and a separating means permitting finished pulverized material to flow out of the grinding chamber to the outlet, yet retaining grinding media.

Conventional bead mills are characterized by a high rotation speed of the agitator. Such high rotation speeds are required to provide high milling rate for fine grinding which mostly happens due to chaotic motion of the grinding media in a turbulent flow colliding with the material to be milled. The use of such elevated rotation speeds is high power consuming with a significant part of the consumed energy being dissipated and converted into heat. Moreover, conventional bead mills are expensive due to the high tolerances required for its parts rotating at high speed.

In U.S. Pat. No. 4,620,673, an agitator shaft is disposed in a milling body which includes a grinding chamber filled with grinding media and material to be ground. Rod-shaped agitating members are fixed on the agitator shaft at equal axial spacing and protruding into spaces between counter-rods fixed to the milling body. The agitator shaft has an end portion in which a cavity is formed which is open at the inner shaft end. The end portion comprises recesses all around the cavity to permit grinding media to flow off which entered the cavity through the inner shaft end. A cylindrical screen cartridge is arranged inside the cavity to permit finished pulverized material to flow out of the grinding chamber to the outlet while it retains grinding media. The milling of particles of size ranging in the micrometer or submicrometer dimensions is not mentioned.

The use of screens and screen cartridges for separation has become a familiar approach; however, they bear the risk of clogging and have a restricted surface. For example, in U.S. Pat. No. 5,797,550, an attrition mill apparatus comprises a grinding chamber having a grinding stage containing an axial impeller fitted with a series of radially directed grinding discs, and a separator and classification stage comprising rotating flat annular disks creating a laminar flux exerting a centrifugal force on the particles, proportional to their mass and allowing for separating large and small particle mass. Here, the separator stage is devoid of a separator screen or comprises a screen which has orifices of larger dimension in comparison with the dimensions of fine particles exiting the chamber at the outlet.

In the case of milling particles down to the submicrometer range, it is difficult to precisely control size range of separated particles using separators based on centrifugal forces because their spatial distribution will overlap, resulting in mixing big particles and small particles. In U.S. Pat. No. 7,264,191, an agitator mill comprises a grinding chamber containing a rotatively drivable agitator which is equipped with agitator implements inside the grinding chamber. The agitator mill also comprises a separator which consists in a plunge pipe partially immersed in the grinding chamber slurry and able to suction selectively fine particles while large particles and beads are driven downstream the grinding chamber by gravity. However, using a plunge pipe as separator reduces the volume of the grinding chamber accordingly or increases the size of the agitator mill. The milling flux is also limited by the size of the plunge pipe. The particle size is not mentioned.

BRIEF SUMMARY OF THE INVENTION

The present application discloses a bead mill which overcomes at least some limitations of the prior art.

The disclosed bead mill can advantageously provide an increased mixing and colliding rate of a milling suspension and an intensification of the comminution process, and provide a simpler construction, minimizing wear.

According to the embodiments, a bead mill for performing wet comminuting can comprise: a stationary vessel having an internal wall and forming a milling chamber to be filled at least partly with milling bodies, raw particles and a carrying liquid to form a suspension within the milling chamber; an activator shaft, rotatable around an axis concentric with the stationary vessel and a rotating activator connected to the activator shaft, to comminute said raw particles to produce milled particles; characterized in that said bead mill further comprises a separator containing a separator chamber disposed substantially vertically, and a laminarization portion providing an upward laminar suspension flow within the separator chamber, to separate the milled particles from the milling bodies and raw particles, the size of the milled particles below which they are separated depending on the flow velocity of said upward laminar suspension flow.

In an embodiment, said laminarization portion comprises one or several laminarization channels disposed substantially vertically, said laminarization channels providing a fluidic connection between the milling chamber and the separator chamber.

In another embodiment, said rotating activator comprises several adjacent rotating members, each rotating member containing several branches extending radially toward the internal wall, and wherein each branch has a distal end at its extremity.

In yet another embodiment, the internal wall contains one or several protruding region extending inward the milling chamber, said protruding region forming a gap with the rotating activator.

In yet another embodiment, said protruding region form a gap with the distal ends of said rotating members when the distal ends pass in the vicinity of the protruding regions during rotation of the rotating activator, and wherein a diverging stream is formed in the vicinity of said gap, comminuting the suspension.

The present application also discloses a method comprising:

downloading milling bodies, raw particles and a carrying liquid within the milling chamber of the bead mill to form a suspension therein;

rotating the activator in the milling chamber to mill the raw particles; and flowing the laminar suspension upwards through the separator at a predetermined flow velocity to provide an upward laminar flow within the separator chamber whereby the milled particles are carried upwards and the milling beads and/or raw particles settle downwards, the size of the milled particles below which they are separated depending on the flow velocity of said upward laminar suspension flow.

BRIEF DESCRIPTION OF THE DRAWINGS

The preferred embodiments will be better understood with the aid of the description of an embodiment given by way of example and illustrated by the figures, in which.

DETAILED DESCRIPTION OF POSSIBLE EMBODIMENTS OF THE INVENTION

Figure 1:
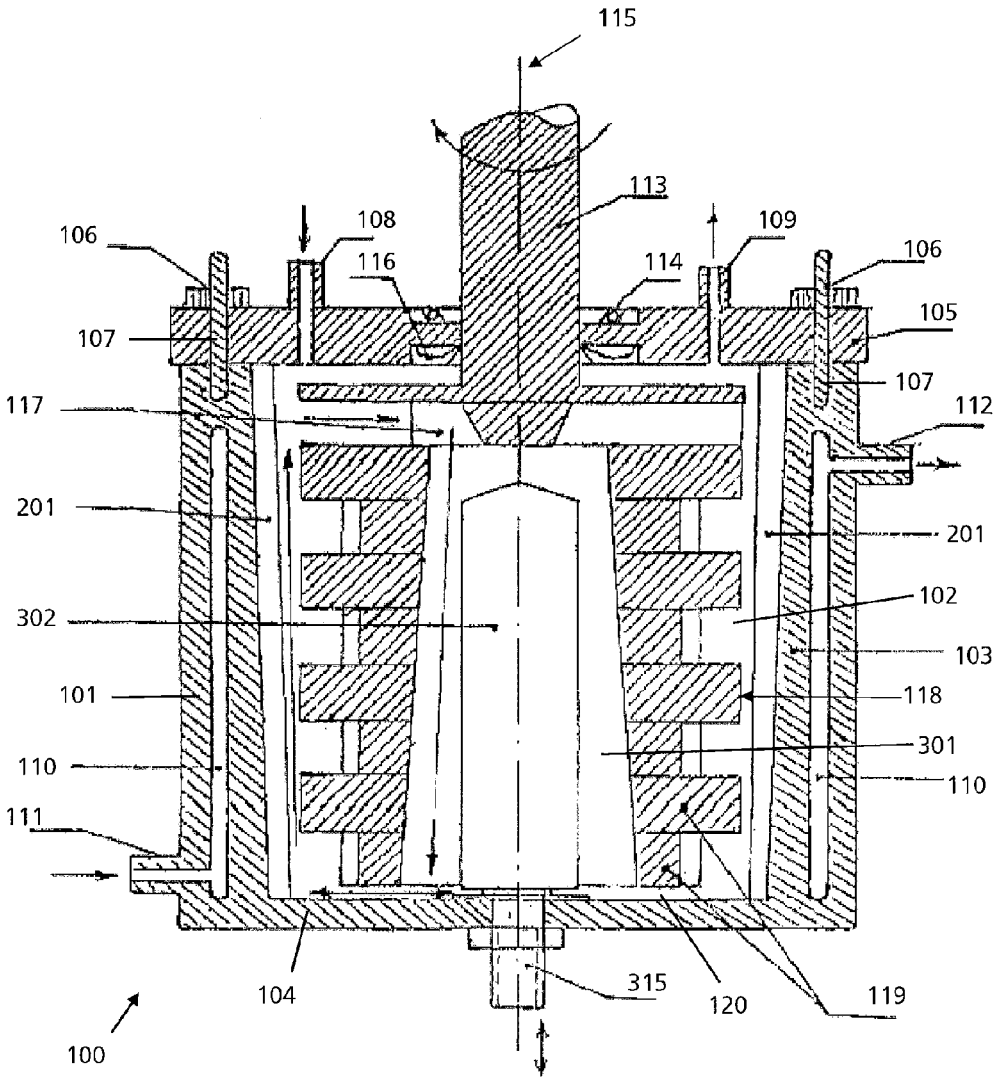
FIG. 1 shows an embodiment of a bead mill.

A bead mill 100 according to an embodiment is represented in FIG. 1. The bead mill 100 comprises a stationary vessel 101 forming a milling chamber 102, having internal walls 103, a bottom plate 104 and a cover 105. The cover is fixed to the cylindrical stationary vessel 101 using screws or bolts 106 screwed into threaded bores 107 in the cylindrical vessel 101. Other fixing means are also possible, for example by screwing a threaded cover 105 on the vessel 101. The cover 105 contains an inlet port 108 allowing milling bodies, or milling beads, material to be milled or raw particles, and a carrying liquid to be introduced into the milling chamber 102 to form a suspension of milling beads and comminuted material, or milled particles. The cover 105 also contains an outlet port 109, allowing for the uploading of the suspension from the milling chamber 102. The stationary vessel 101 comprises a cooling jacket 110 having a coolant input 111 and coolant output 112 allowing for a coolant to circulate within the cooling jacket 110 in order to cool the suspension within the milling chamber 102.

The bead mill 100 further comprises an activator shaft 113 rotatively mounted in the cover 105, for example in bearings 114, and able to rotate around a bead mill axis 115 concentric with the cylindrical vessel 101. As shown in FIG. 1, the cover 105 can also comprise a sealing 116 around the activator shaft 113 in order to avoid possible leaks of the suspension out of the milling chamber 102. The activator shaft 113 may be driven by an electric motor (not shown) or any other type of driving motor.

In an embodiment, the activator shaft 113 extends slightly within the milling chamber 102 and a circulation pump 117 is attached to its lower end. The circulation pump 117 is used for mixing the suspension within the milling chamber 102. Alternatively, more than one circulation pump 117 can be attached to the activator shaft 113.

A rotating activator 118 is fixedly connected to the activator shaft 113 through the circulation pump 117. In an embodiment represented in FIG. 1, the rotating activator 118 is formed from eight rotating members 119 coaxially stacked. A clearance 120 is provided between the inferior face of the rotating activator 118 and surface of the bottom plate 104, in order to ensure a good circulation of the suspension within the milling chamber 102. The rotating activator 118 can comprise any other number of rotating members 119, although the use of several rotating members 119 is advantageous in order to provide increased comminution of the raw particles. The rotating activator 118 comprises a cavity 301 concentric with the bead mill axis 115 and in fluidic communication with the milling chamber 102. The suspension is circulated from the milling chamber 102 to the cavity 301 by the action of the circulation pump 117.

In an embodiment, the rotating activator 118 comprising the several rotating members 119 is made from a single piece.

In another embodiment, openings (not represented) such as radial openings, holes or notches are provided on the rotating members 119 in order to connect fluidly the suspension between the milling chamber 102 and the cavity 301. Preferably, the openings are provided on the shortest external radius between the bead mill axis 115 and distal ends 123 of the rotating members 119.

Figure 2:
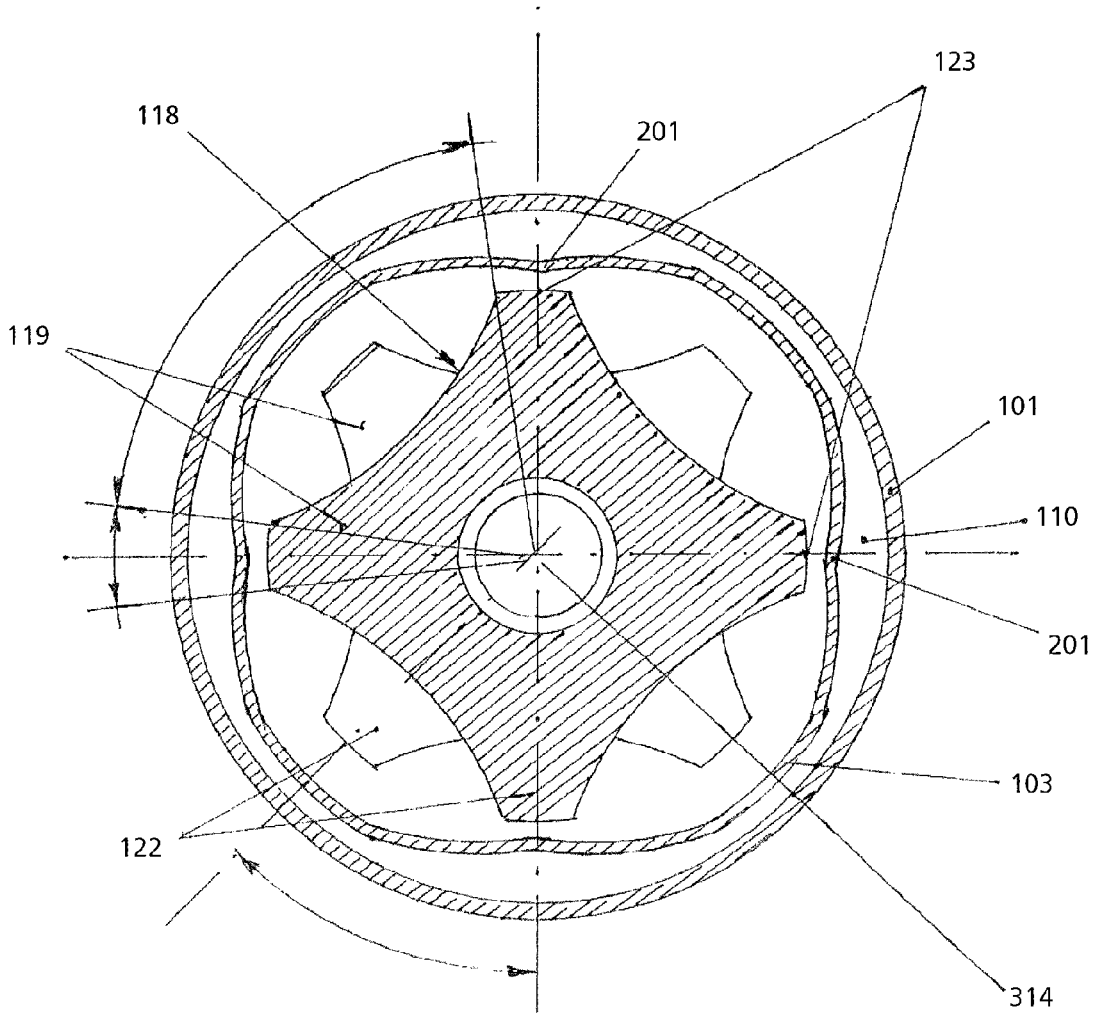
FIG. 2 illustrates a top view of an embodiment of the bead mill milling comprising a milling chamber and a rotating activator.
Figure 3:
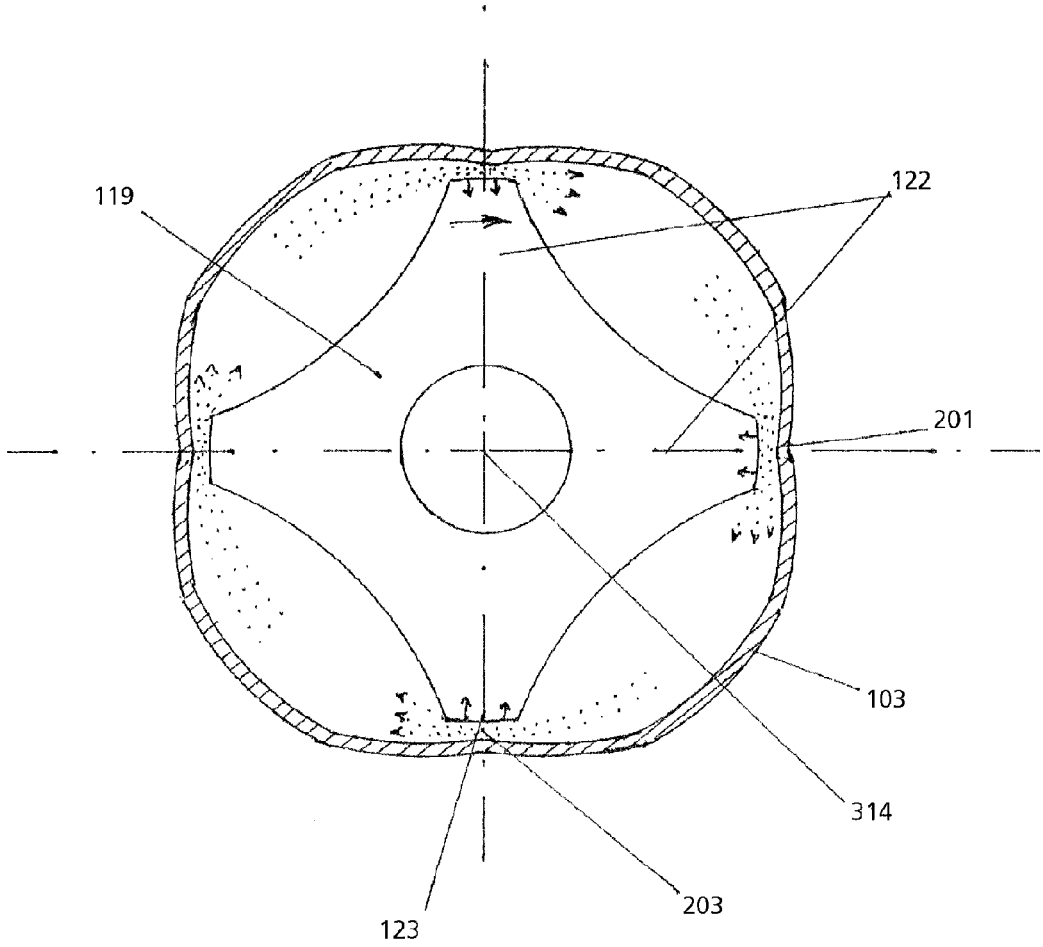
FIG. 3 illustrates the formation of a diverging stream formed between the milling chamber and the rotating activator.

FIGS. 2 and 3 illustrate the milling chamber 102 with the rotating activator 118 viewed from the top, the cover 105 being removed. More particularly, FIG. 2 shows two superimposed rotating members 119 being angularly shifted by an angle of about 45° with respect to their adjacent rotating members 119. In the examples of FIGS. 2 and 3, the rotating members 119 are cross-shaped, each rotating member 119 comprising four equally radially distributed branches 122, extending radially toward the internal wall 103, each branch 122 comprising distal end 123 that are substantially flat at its outward extremity. The internal wall 103 comprises four protruding regions 201 extending inward the milling chamber 102 and longitudinally along the internal wall 103. In the examples of FIGS. 2 and 3, the internal wall 103 has a uniform wall thickness in order to ensure that heat transfer from the milling chamber 102 to the cooling jacket 110 is uniform for the entire surface area of the internal wall 103.

During the rotation of the activator 118, a narrow gap 203 is formed between the protruding regions 201 and the rotating activator 118. For example, the narrow gap 203 can be formed between the protruding regions 201 and the distal ends 123 of the branches 122 of the rotating activator 118, when the branches 122 pass in the vicinity of the protruding regions 201 during the rotation of the rotating activator 118. In the case the protruding region 201 are tip-shaped (see FIG. 3), the gap is at its narrowest between the distal end 123 and the tip of the tip-shaped protruding region 201. For example, at its narrowest, the gap can have a value comprised between 0.5 mm and 3 mm.

More particularly, during the rotation of the activator 118, an intensive tangential flow of suspension is created within the milling chamber 102. In the vicinity and within the gap 203, the suspension stream experiences a high hydrodynamic resistance, similarly to what happens in converging-diverging nozzles. As a result, in the vicinity of the gap 203, the suspension flow is converted from a tangential stream into a stream that is directed forward, upward and downward the gap, thus forming a diverging stream as exemplified schematically in FIG. 3. The diverging stream imparts rotational movement to the milling beads and the raw particles, causing the raw particles to swirl around relative to the cylindrical vessel 10. Consequently, the mixing and colliding rate of the milling beads and the raw particles is enhanced, resulting in a high intensity comminuting of the raw particles. Here, the tip-shape protruding region 201 is favorable in producing a strong diverging stream able to produce high intensity comminuting. However, other configurations of the protruding regions 201 are possible. For example, the protruding regions 201 can have a triangular shape, a rectangular shape or a semi-circular shape, or any other shape able to produce a diverging-like stream to increase the comminuting intensity.

In an embodiment not represented, the internal wall 103 comprise a profile, such as a corrugated profile or a triangular profile, the profile having the same function as the protruding regions 201.

Since each rotating member 119 is angularly shifted with respect to the two adjacent rotating members 119, the formation of the gaps 203 between the distal ends 123 and the protruding regions 201 for one of the rotating member 119 does not coincide with the formation of the gaps 203 for the adjacent rotating members 119. This allows for the upward and downward streams of the diverging stream created by one rotating member 119 to collide with the tangential streams formed in the two adjacent (upper and lower) rotating members 119. This further increases the mixing and colliding rate of the milling beads and the raw particles and thus, the milling rate. Here, the adjacent rotating members 119 can be angularly shifted by an angle different from 45°. Preferably, each rotating member 119 is angularly shifted to the adjacent rotating members 119 by an angle comprised between 20° and 70°.

The increased mixing and colliding rate of the suspension leads to the intensification of the comminution process and allows for using low rotation speeds of the rotating activator 118, while obtaining high milling intensity. For example, a linear speed comprised between 5 and 30 m/s as measured at the distal end 123 of the rotating members 119 can be used to produce milled particles in the submicrometer range, or nanoparticles.

Compared to the conventional bead mill apparatuses, the bead mill 100 as disclosed herein has an increased milling efficiency allowing for producing milled particles in the nanometer range in a shorter time period. The use of reduced rotation speeds for the rotating activator 118 results in lower power consumption, lower power dissipation, and less wear of the rotating activator 118 and internal wall 103. Moreover, the use of reduced activator rotation speeds allows for a simpler and cheaper design of the bead mill 100.

The disclosure is susceptible to various modifications and alternative forms, and specific examples thereof have been shown by way of example in the drawings and are herein described in detail. It should be understood, however, that the disclosure is not to be limited to the particular forms or methods disclosed, but to the contrary, the disclosure is to cover all modifications, equivalents, and alternatives.

For example, the number of protruding regions 201 can be inferior or superior to four. A larger number of protruding regions 201 will result in an increased number of diverging streams and a higher mixing and colliding rate of the milling bodies and the material to be milled, and thus, a higher milling rate. Conversely, a smaller number of protruding regions 201 will result in a lower milling rate. This later option may however be of interest, for example, in the case of an application requiring a small and compact bead mill 100. In addition to the protruding regions 201, the internal wall 103 can also contain one or several deflectors (not shown) located at various circumferential locations about the internal wall 103 and having a similar role as the one of the protruding regions 201, and/or use to simply enhance the mixing of the suspension during the rotation of the rotating activator 118. The deflectors can have a triangular shape, semi-circular shape, or any other shape suitable to its enhancing function. Alternatively, the protruding regions 201 can be formed by a deformation of the internal wall 103 or by a varying thickness of the internal wall 103.

Preferably, the rotating members 118 comprises a number of branches 122 equivalent to the number of protruding regions 201, such as in the configuration of FIG. 2. However, the rotating members 118 having a number of branches 122 different from the number of protruding regions 201 is also possible. An example of the latter configuration is the rotating members 118 having a number of branches 122 smaller than the number of protruding regions 201 of the internal wall 102 having a corrugated profile.

In an embodiment not represented, the rotating members 119 are disc shaped, the distal end 123 corresponding to the disc periphery, and the gap 203 being formed between the disc periphery and the protruding regions 201. In comparison with the rotating activator 118 containing the stack of radially shifted cross-shaped rotating members 119 described above, the use of a stack of disc-shaped rotating members 119 may limit the upward and downward streams due to the narrower space between the discs periphery and the internal wall, in between two adjacent protruding regions 201, thus possibly lowering the milling rate.

In another embodiment not represented, each rotating member 119 comprises 2n branches 122 equally angularly distributed, where n is an integer and is correlated with the diameter of the milling chamber 102. Here, each rotating member 119 is axially shifted by 180°/n with respect to the two adjacent rotating members 119.

In yet another embodiment not represented, the rotating members 119 are formed from one or several horizontal rod-shaped branches 122, for example, of substantially uniform length, and have a substantially equal axial distribution along the activator axis 115. Alternatively, the rotating members 119 can be formed from of one or several horizontal blade-shaped branches 122.

In yet another embodiment, the rotating activator 118 is fixedly connected directly to the activator shaft 113 and, in the absence of circulation pump 117, the mixing of the suspension is achieved solely through the rotation of the rotating activator 118.

A higher milling rate can possibly be obtained by increasing the diameter of the rotating activator 118, increasing the peripheral velocity of the distal ends 123. Moreover, in the case the milling chamber has a large diameter, an increased number of protruding regions 201 and rotating members 119 results in an increased particle collision rate within the tangential and vertical suspension streams, and higher milling intensity.

According to an embodiment, the bead mill 100 comprises a separator 302 used to separate milled particles having a size equal and/or below a predetermined value from the milling beads and raw particles. In the example of FIG. 1, the separator 302 is disposed within the bead mill cavity 301, non-rotatably fixed with the stationary vessel 101 and coaxial with the bead mill axis 115. Preferably, the respective inner diameter of the cavity 301 and external diameter of the separator 302 are such as to provide a gap between the cavity 301 and the separator 302 where the suspension can freely flow under the action of the circulation pump 117 or the rotation of the activator 118.

Figure 4:
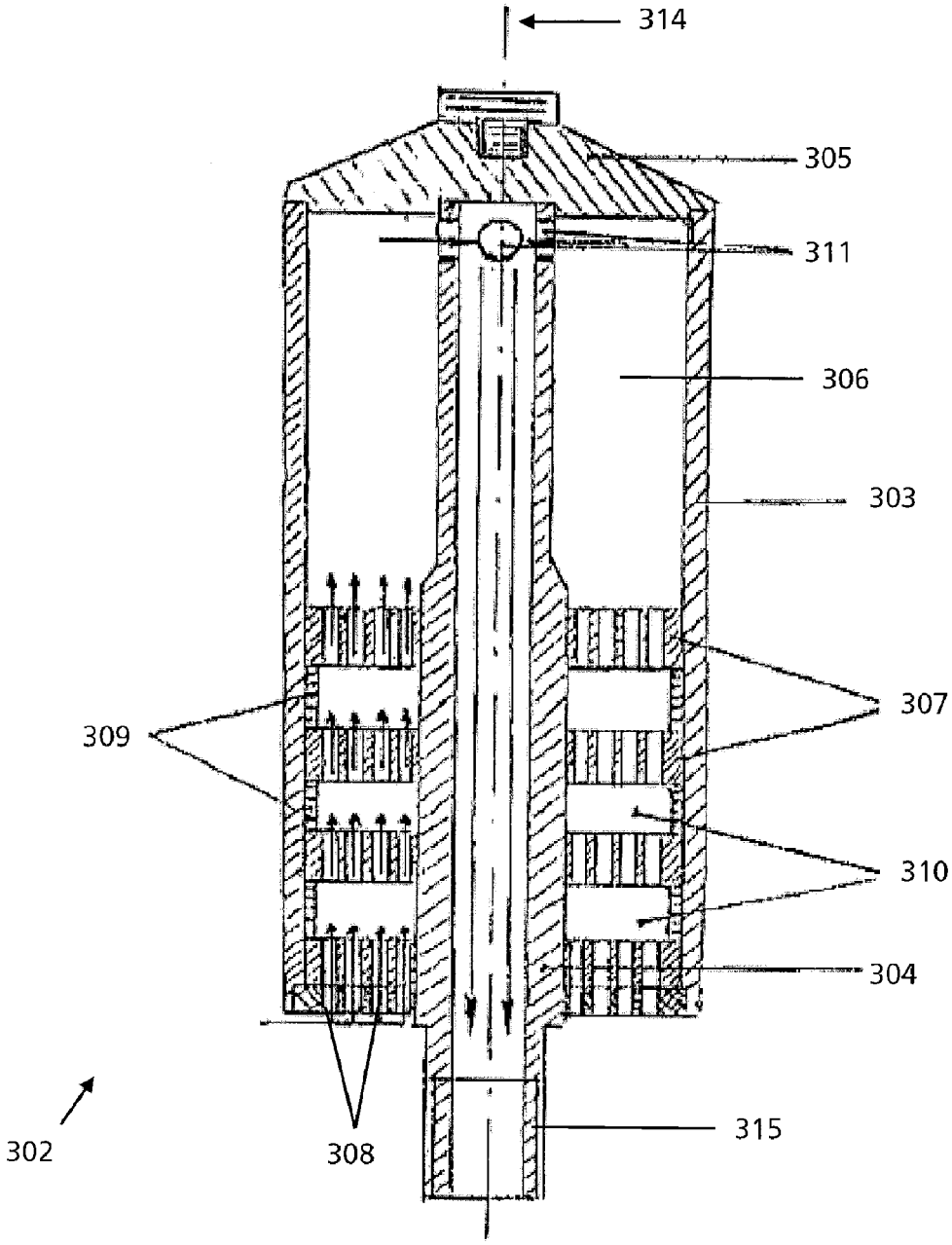
FIG. 4 shows a detailed view of a separator according to an embodiment.

FIG. 4 illustrates a detailed view of the separator 302 according to one embodiment. In the example of FIG. 4, the separator 302 comprises the hollow cylinder 303 coaxial with a hollow separator tube 304 and a separator axis 314. A separator cover 305 closes the hollow cylinder 303 and the separator tube 304, delimitating a separator chamber 306 between the hollow cylinder 303 and separator tube 304, the separator chamber 306 being disposed substantially vertically. The separator tube 304 comprises one or several opening 311 providing a fluidic connection between the separator chamber 306 and the interior of the separator tube 304.

The separator 302 further comprises a laminarization portion used to make the suspension flow laminar when entering the separator chamber 306. In the example of FIG. 4, the laminarization portion if formed from four laminarization discs 307, disposed in the lower part of the separator chamber 306. The annular laminarization discs 307 extend substantially perpendicular with the bead mill axis 115, between the hollow cylinder 303 and the separator tube 304. The laminarization discs 307 are preferably spaced with spacer rings 309 delimitating laminarization chambers 310, corresponding to the volume comprised between the adjacent laminarization discs 307. Alternatively, the laminarization discs 307 can be disposed within the separator chamber 306 without using the spacer rings 309.

Figure 5:
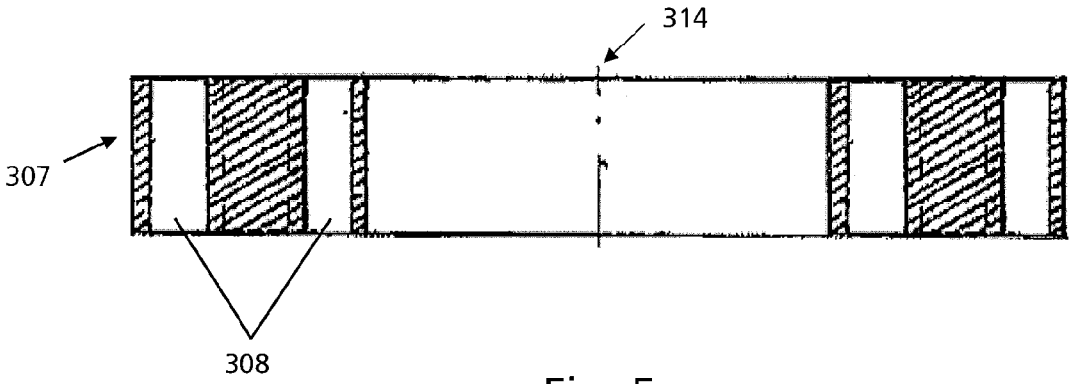
FIG. 5 shows an embodiment of a laminarization disc viewed along its cross section.
Figure 6:
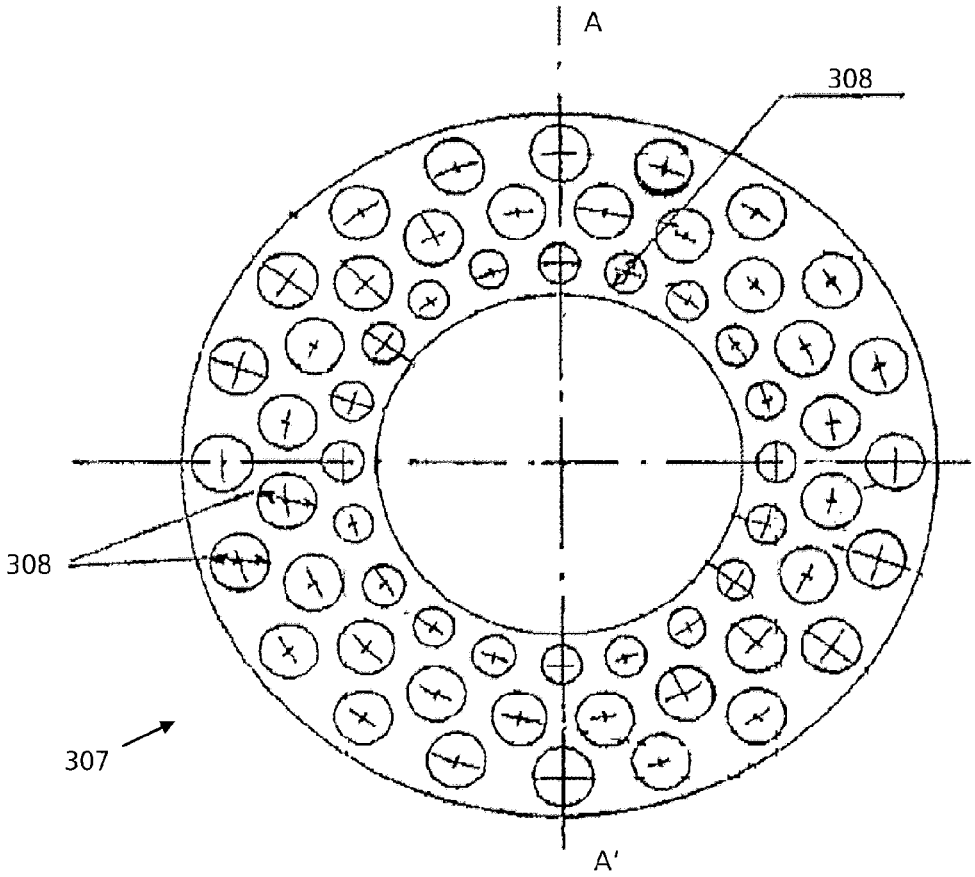
FIG. 6 shows a top view of the laminarization disc of FIG. 5.

A detailed view of one of the laminarization discs 307 is represented viewed from the top in FIG. 6, and viewed along its cross section A-A' in FIG. 5. In the examples of FIGS. 5 and 6, the laminarization disc 307 contains several flow apertures 308, distributed substantially evenly across its surface. Preferably, the diameter of the flow apertures 308 is sufficiently small to promote the laminarization of the suspension flow when flowing through them, but not so small as to be prone to clogging by the milling beads and raw particles. For example, the flow apertures 308 can have a diameter comprised between 2 mm and 3 mm, and the laminarization discs 307 can have a thickness up to 10 mm, such as to obtain a laminar flow when the suspension enter the separator chamber 306 after passing through the four laminarization discs 307.

Other configurations of the laminarization discs 307 are also possible, as long as a laminar suspension flow within the separator chamber 306 is achieved. For example, the separator 302 can contains less or more than four laminarization discs 307, the latter being possibly unevenly spaced form one another within the separator 302. Moreover, the diameter or size of the flow apertures 308 can vary across the surface of the laminarization disc 307. The shape of the flow apertures 308 is not limited to a circular shape but can have any shape such as an elliptical shape, a rectangular shape, etc.

During mixing of the suspension by the rotating activator 118, and possibly also by the circulation pump 117, the turbulent suspension enter the separator 302, and flows upward through the successive laminarization discs 307 and laminarization chambers 310, into the separator chamber 306. The laminar suspension continues flowing downward the separator tube 304, via the openings 311.

Within the separator chamber 306, the upward laminar suspension flow exerts a dragging and a buoyancy force on the milling beads, raw and milled particles contained in the suspension. The dragging buoyancy forces are however competing with the gravitational force. Here, the milling beads and raw particles being typically larger and heavier than the milled particles are more strongly influenced by the gravitational forces. Consequently, for a suitable suspension viscosity and predetermined flow velocity of the upward laminar suspension flow, the milling beads and raw particles are mostly carried downward by the gravitational force and returned to the milling chamber 102, via the cavity 301, while the milled particles are mostly carried by the upward flow due to drag and buoyancy forces. More particularly, the critical size of the milled particles below which they will be carried by the upward flow and, therefore, separated from the milling beads and raw particles, varies with the laminar flow velocity. The lower is the flow velocity, the smaller the size of the milled particles susceptible to be separated from the milling beads and raw particles. The upward laminar flow of carrying liquid and separated milled particles then flows into the separator tube 304 via the openings 311 and through a separator outlet 315, fluidly connected to the separator tube 304, from where the carrying liquid and the separated particles exit the separator 302. For the sake of simplicity, in the present description the expression "milled particles" refers to milled particles having a size equal or below the critical size and the expression "raw particles" refers to particles having a size above the critical size.

In an embodiment, the predetermined velocity of the upward laminar suspension flow allows for separating milled particles in the submicron range, for example, having a size equal or below 500 nm.

In another embodiment not represented, the velocity of the upward laminar suspension flow is controlled using a separator suction pump, the suction pump being fluidly connected to the separator 302, for example, to the separator outlet 315, and forcing the suspension to flow through the separator 302 and the separator tube 304. Here, the velocity of the upward laminar suspension flow can be varied by controlling the flow rate the suction pump applies on the laminar suspension flow.

The separation process of the milled particles described above is possible in a laminar flow. In a turbulent flow, the separation process would be affected by turbulent random forces that can possibly exceed shear forces imposed by laminar viscous flow.

Figure 7:
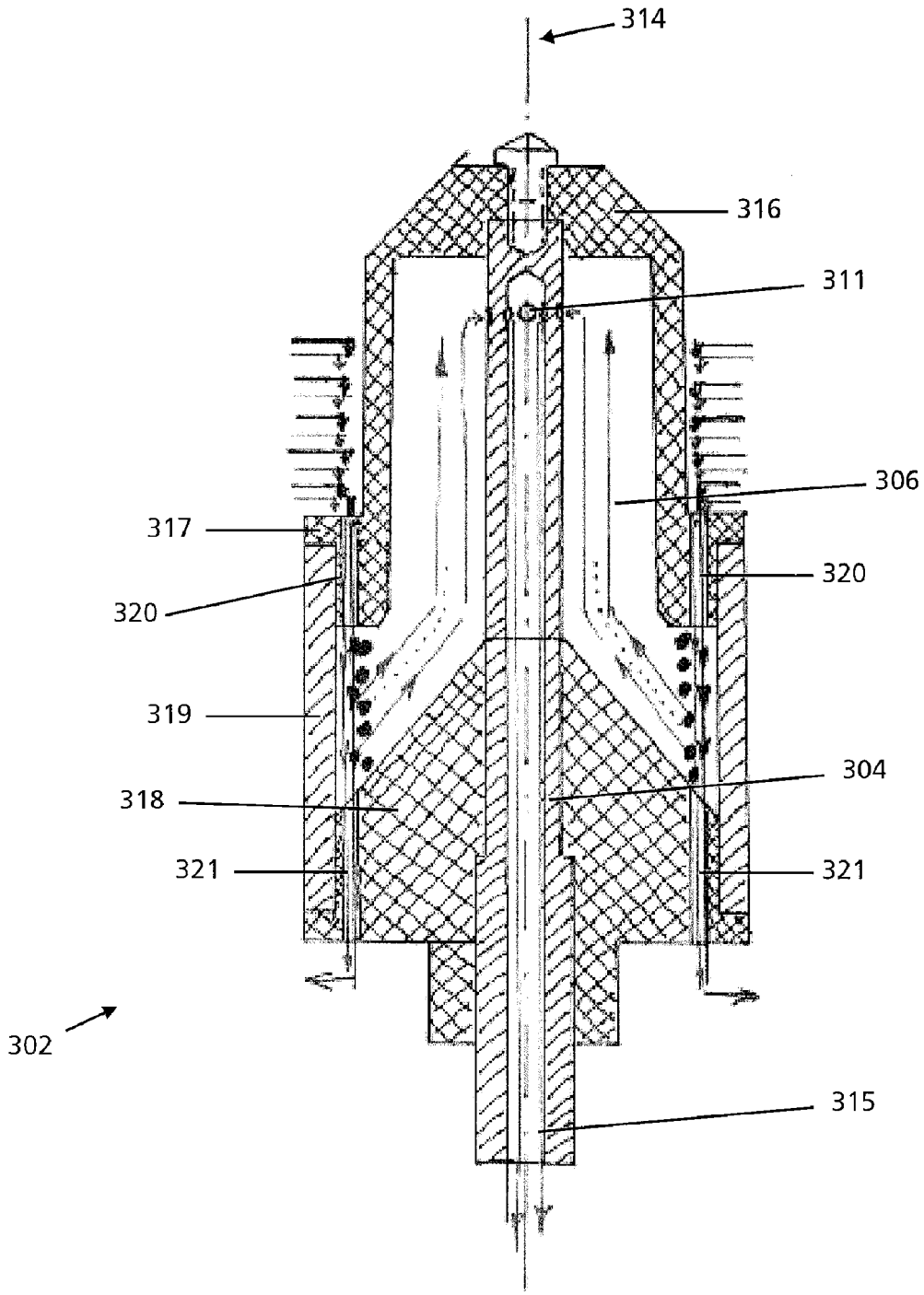
FIG. 7 illustrates a preferred embodiment of the separator.

In a preferred embodiment represented in FIG. 7, the separator 302 comprises an upper element 316 having a cylindrical hollow shape with a flanged part 317, the upper element 316 being coaxial with the separator tube 304 and closing the separator 302 at its upper end. The separator 302 further comprises a lower element 318 having a frustoconical shape and closing the separator 302 at its lower end, the upper and lower elements 316, 318 being fixed together by a fixation tube 319, also coaxial with the separator axis 314 and bead mill axis 115. The frustoconical shape of the lower element 318 can advantageously direct large particles from the separator 302 to the milling chamber 102, avoiding collecting the large particle in the separator 302. Other shape of the lower element 318 having the same function is however also possible. The separator tube 304, disposed substantially coaxially with the separation chamber 306, the upper element 316, the fixation tube 319, and the lower element 318 define the separator chamber 306 therebetween. In this configuration, the separator chamber 306 is disposed substantially vertically. Similarly to the separator 302 of the previous embodiment, the separator tube 304 comprises one or several openings 311 at its upper extremity, the openings 311 providing a fluidic connection between the separator chamber 306 and the interior of the separator tube 304.

In a preferred embodiment, the separator tube 304 is provided with four round openings 311.

In a variant of the embodiment, the upper element 316, lower element 318 and the fixation tube 319 are made in a single piece.

In the configuration of FIG. 7, the laminarization portion of the separator 302 is formed from one or several laminarization channels 320, disposed substantially vertically in the flanged part 317 of the upper element 316. The lower element 318 of the separator chamber 306 contains exit channels 321, both laminarization channels 320 and exit channels 321 providing a fluidic connection between the lower extremity of the separator chamber 306 and the milling chamber 102, via the cavity 301. During mixing of the suspension, the turbulent suspension circulates from the milling chamber 102, via the cavity 301, downward the laminarization channels 320, and enters the separator chamber 306. The laminar suspension flow continues flowing upward within the separator chamber 306. For a suitable suspension viscosity and predetermined velocity of the upward laminar suspension flow within the separator chamber 306, the milling beads and raw particles tend to be carried by gravity downward and returned to the milling chamber 102, via the cavity 301, through the exit channels 321. On the other hand, the milled particles are mostly carried upward by the upward laminar suspension flow, and downward the separator tube 304, via the openings 311, to the separator outlet 315 where the suspension containing the separated milled particles exits the separator 302. Other configurations of the separator tube 304 are also possible, as long as they can allow the laminar suspension to flow from the upper extremity of the separator chamber 306 to the separator outlet. For example, the separator tube 304 can be disposed substantially parallel with the separator axis 314 but not coaxial with the separator chamber 306.

The size of the milled particles below which they are carried by the upward laminar suspension flow and, therefore, separated from the milling beads and raw particles, varies with the laminar flow velocity. The lower is the upward flow velocity, the smaller the size of the milled particles susceptible to be separated from the milling beads and raw particles.

The disclosed embodiments are susceptible to various modifications and alternative forms, and specific examples thereof have been shown by way of example in the drawings and are herein described in detail. It should be understood, however, that the disclosed embodiments are not to be limited to the particular forms or methods disclosed, but to the contrary, the disclosed embodiments are to cover all modifications, equivalents, and alternatives.

For example, in an embodiment, the separator 302 is placed below the activator 118 and coaxial with the latter.

In another embodiment, the separator 302 is placed parallel with the bead mill 100 but not coaxial with the bead mill axis 115. For example, the separator 302 is disposed beside the activator 118, within the internal wall 103. In this configuration, the separator suction pump can be used to flow the suspension through the separator 302.

The separator 302 comprises no mobile part and is consequently of simpler construction and minimize wear. Since the separator 302 does not contain sieve or screen, possible clogging by the milling beads and raw particles is avoided. Moreover, the size below which the milled particles are separated from milling beads and raw particles can be easily determined by controlling the upward laminar suspension flow velocity.

The bead mill 100 comprising the separator 302 can be advantageously used for producing milled particles by a wet comminution process, by providing milling beads, and a suitable carrying liquid, such as water with a surfactant, ethanol, or glycerol, into the milling chamber 102 via the inlet port 108, in order to produce a suspension within the milling chamber 102. The activator 118 is then rotated to mix the suspension and comminute the particles. During the activator rotation, a coolant is circulated through the cooling jacket 110 for dissipating at least part of the heat generated during the comminution process. The mixed suspension circulates from the milling chamber 102, within the cavity 301 and through the laminarization portion 307, 320 of the separator 302, producing an upward laminar suspension flow having a predetermined flow velocity within the separator chamber 306, where the milled particles are separated from the milling beads and raw particles. The upward laminar suspension flow containing the separated milled particles then leaves the separator 302 through the separator outlet 315, via the separator tube 304.

In an embodiment, the velocity of the upward laminar suspension flow is controlled using the separator suction pump.

In another embodiment, at least one of the circulating pump 117 is used to circulate the suspension within the milling chamber 102 and the cavity 310, and to provide uniform milling conditions.

In yet another embodiment not represented, the bead mill 100 further comprises a temperature control system comprising a temperature sensor, for example placed within the milling chamber 102, controlling a valve that is able to regulate the coolant flow. Here, the temperature sensor output can be used to control the valve, for example using a loop procedure, in order to regulate the coolant flow and maintain the temperature of the suspension within the milling chamber 102 to a fixed predetermined value.

The temperature control system can be used to maintain the temperature of the suspension to a predetermined value that is high enough to lower the suspension viscosity in order to reduce the torque needed for rotating the agitator 118, and thus the power consumption. In a preferred embodiment, the temperature control system is used to maintain the suspension at a temperature above 40° C.

During the comminution process described above, fresh raw particles and carrying liquid can be supplemented to the bead mill 100 through the inlet port 108 in order to compensate the separated milled particles and carrying liquid that leave the separator 302, and possibly the bead mill 100, through the separator outlet 315, and ensure that the total quantity of the suspension in the milling chamber 102 is maintained at a substantially constant level.

The wet comminution process using the bead mill 100 is performed during a period of time needed to produce separated predetermined quantity of milled particles having a predetermined, or targeted, size. The duration of the wet comminution process depends on the nature and size of the raw particles and milling beads. In practice, the duration of the wet comminution process is determined through trial comminution runs, where the size of the separated milled particles are measured, typically at different time intervals, for example, every 30 minutes.

In a preferred embodiment, a peristaltic pump is used to extract a quantity of the suspension flowing through the separator outlet 315, during the wet comminution process. The size of the separated milled particles contained in the extracted suspension can then be measured in-line, for example, using any suitable in-line measurement method. As long as the measured particle size is above the predetermined size, the suspension flowing through the separator outlet 315 is returned to the milling chamber 102. Once the milled particle have a measured size corresponding to the predetermined size or below, the suspension containing the milled particles is then be flowed out of the bead mill 100.

Using milling beads having a size comprised within a range between 50 μm to 500 μm and raw particles having a size comprised within a range between 0.1 μm to 100 μm, preferably comprised within a range between 0.1 μm to 10 μm, milled particles with size in the submicron range can be produced with the bead mill 100.

The present disclosure also relates to a bead mill 100 for performing wet comminuting comprising a stationary vessel 101 having an internal wall 103 and forming a milling chamber 102 to be filled at least partly with milling beads, raw particles and a carrying liquid in order to form a suspension within the chamber 102; a drive shaft 113, rotatable around an axis 115 concentric with the stationary vessel 101; and a rotating activator 118, comprising several rotating members 119, each rotating member 119 having at least one branch 122, extending radially toward the internal wall 103 and comprising a distal end 123, the rotating activator 118 being drivingly connected to the shaft 113; wherein said internal wall 103 contains one or several protruding regions 201, extending inward the milling chamber 102, and forming a gap 203 with the distal ends 123, when said distal ends 123 passes in front of the protruding regions 201 during rotation of the rotating activator 118, forming a diverging stream in the vicinity of said gap 203 to comminute the suspension.

Here, the bead mill 100 can be used without the separator 302, for example, using a batch type method where the raw particles are wet comminuted in the bead mill 100 for a predetermined period of time. Here, the milled particles are separated from the milling beads and raw particles using a sieve, screen, screen cartridge, or any other separation means.

REFERENCE NUMBERS

100 bead mill
101 stationary vessel
102 milling chamber
103 internal wall
104 bottom plate
105 cover
106 screw
107 threaded bore
108 inlet port
109 outlet port
110 cooling jacket
111 coolant input
112 coolant output
113 activator shaft
114 bearings
115 bead mill axis
116 sealing
117 circulation pump
118 rotating activator
119 rotating members
120 clearance
122 branch
123 distal end
201 protruding region
203 gap
301 cavity
302 separator
303 hollow cylinder
304 separator tube
305 separator cover
306 separator chamber
307 laminarization disc
308 flow apertures
309 spacer rings
310 laminarization chamber
311 opening
314 separator axis
315 separator outlet
316 upper element
317 flanged part of the upper element
318 lower element
319 fixation tube
320 laminarization channel
321 exit channel

The invention claimed is:

1. A bead mill for performing wet comminuting comprising:

a stationary vessel having an internal wall and forming a milling chamber to be filled at least partly with milling bodies, raw particles and a carrying liquid to form a suspension within the milling chamber;

an activator shaft, rotatable around an axis concentric with the stationary vessel and a rotating activator connected to the activator shaft, to comminute said raw particles to produce milled particles;

said bead mill further comprises a separator containing a separator chamber disposed substantially vertically, and a laminarization portion providing an upward laminar suspension flow within the separator chamber, to separate the milled particles from the milling bodies and raw particles, the size of the milled particles below which they are separated depending on the flow velocity of said upward laminar suspension flow.

2. The bead mill according to claim 1, wherein said laminarization portion comprises one or several laminarization channels disposed substantially vertically, said laminarization channels providing a fluidic connection between the milling chamber and the separator chamber.

3. The bead mill according to claim 1, wherein the separator further comprises one or several exit channels, disposed substantially vertically and providing a fluidic connection between the lower extremity of the separator chamber and the milling chamber, to return the milling bodies and raw particles from the separator chamber to the milling chamber.

4. The bead mill according to claim 1, wherein the separator further comprises a hollow separator tube containing at least one opening and a separator outlet, said hollow separator tube being fluidly connected to the separator outlet to exit the carrying liquid and separated milled particles from the separator.

5. The bead mill according to claim 4, wherein the separator tube comprises four openings.

6. The bead mill according to claim 1, wherein the separator further comprises a separator suction pump for controlling the velocity of said upward laminar suspension flow.

7. The bead mill according to claim 1, wherein said rotating activator comprises a cavity provided concentric within the rotating activator and in fluidic communication with the milling chamber, and wherein the separator is disposed within said cavity, concentric with the rotating activator.

8. The bead mill according to claim 1, wherein said laminarization portion is formed from at least one laminarization disc containing several flow apertures.

9. The bead mill according to claim 8, wherein said flow apertures are distributed substantially evenly over the surface of said at least one laminarization disc.

10. The bead mill according to claim 1, wherein said rotating activator comprises several adjacent rotating members, each rotating member containing several branches extending radially toward the internal wall, and wherein each branch has a distal end at its extremity.

11. The bead mill according to claim 10, wherein said each rotating member is angularly shifted to the adjacent rotating members by an angle comprised between 20° and 70°.

12. The bead mill according to claim 10, wherein said each rotating member is angularly shifted to the adjacent rotating members by an angle of 45°.

13. The bead mill according to claim 10, wherein the rotating members are cross shaped and comprise four branches equally angularly distributed.

14. The bead mill according to claim 10, wherein the rotating activator is formed from eight rotating members coaxially stacked.

15. The bead mill according to claim 1, wherein the internal wall contains one or several protruding region extending inward the milling chamber, said protruding region forming a gap with the rotating activator.

16. The bead mill according to claim 15, wherein said protruding region form a gap with the distal ends of said rotating members when the distal ends pass in the vicinity of the protruding regions during rotation of the rotating activator, and wherein a diverging stream is formed in the vicinity of said gap, comminuting the suspension.

17. The bead mill according to claim 15, wherein the number of branches is equivalent to the number of protruding regions.

18. The bead mill according to claim 15, wherein the protruding regions are tip shaped.

19. The bead mill according to claim 1, wherein at least one circulation pump is attached to the activator shaft to mix the suspension within the milling chamber.

20. The bead mill according to claim 1, wherein the milling chamber comprises a cooling jacket to circulate a coolant to cool the suspension within the milling chamber.

21. The bead mill according to claim 20, wherein the bead mill further comprises a temperature sensor able to deliver a temperature sensor output, and a valve able to regulate the flow of said coolant; and wherein said valve is controlled by the temperature sensor output to regulate the flow of said coolant for maintaining a temperature of the suspension to a fixed predetermined value.

* * * * *